United States Patent [19]

Spademan

[11] Patent Number: 4,600,214

[45] Date of Patent: Jul. 15, 1986

[54] SKI BOOT LOCATING APPARATUS

[76] Inventor: Richard G. Spademan, Box 6410, Incline Village, Nev. 89450

[21] Appl. No.: 696,301

[22] Filed: Jan. 30, 1985

Related U.S. Application Data

[63] Continuation-in-part of Ser. No. 470,128, Feb. 28, 1983, abandoned, which is a continuation-in-part of Ser. No. 255,623, Apr. 20, 1981, Pat. No. 4,407,520.

[51] Int. Cl.[4] ..... A63C 9/08

[52] U.S. Cl. ..... 280/624; 280/634

[58] Field of Search ..... 280/624, 611, 625, 631, 280/632, 634

[56] References Cited

U.S. PATENT DOCUMENTS

| | | | |
|---|---|---|---|
| 3,140,877 | 7/1964 | Spademan | 280/624 |
| 3,271,040 | 9/1966 | Spademan | 280/624 |
| 3,560,011 | 2/1971 | Spademan | 280/624 |
| 3,606,370 | 9/1971 | Spademan | 280/624 |
| 3,884,492 | 5/1975 | Spademan | 280/624 |
| 3,891,227 | 6/1975 | Spademan | 280/624 |
| 3,905,613 | 9/1975 | Romeo | 280/623 |
| 4,063,752 | 12/1977 | Whitaker et al. | 280/624 |
| 4,135,736 | 1/1979 | Druss | 280/636 |

*Primary Examiner*—John J. Love
*Assistant Examiner*—Michael Mar
*Attorney, Agent, or Firm*—Townsend and Townsend

[57] ABSTRACT

In a ski binding 1 there is provided ski boot heel locating members 30, 31 for locating a ski boot mounted plate 3 between a pair of clamping members 16, 17. The plate member 3 is provided with curved lateral edges 4, 5 the forward edge of which is provided with a length and angle for moving the plate 3 and the ski boot 2 to which it is attached forwardly at a distance sufficient for the heel of the ski boot 2 to clear the forward edge of the heel locating members 30, 31 during a lateral release as the plate 3 and clamping members 16, 17 are engaged. The ski boot heel is provided with a wedge-shaped tab 36 extending rearwardly, while the heel locating members are notched 39, 40 to receive and retain the tab corners during lowering of the boot into the binding. Openings 41, 42 are located at the bottom of each notch to permit release of the tab in the forward direction when the boot is fully lowered against the ski.

8 Claims, 7 Drawing Figures

SKI BOOT LOCATING APPARATUS

BACKGROUND OF THE INVENTION

This application is a continuation-in-part of application Ser. No. 470,128, filed Feb. 28, 1983 now abandoned, which is a continuation-in-part of applicaiton Ser. No. 255,623, filed Apr. 20, 1981 now U.S. Pat. No. 4,407,520.

The present invention relates to ski binding apparatus in general and, more specifically, to a ski boot locating apparatus for centering a ski boot in a ski binding of the type designed for releasably securing the ski boot to the ski rearward of the toe and forward of the rear of the heel of the ski boot as disclosed in U.S. Pat. Nos. 3,271,040 3,606,370, 3,891,227 and 4,063,752.

In each of the above patents there is disclosed and described separable ski and boot mounted members. The members are provided for releasably securing the ski boot to a ski rearward of the toe and forward of the rear of the heel of a ski boot. In each of the embodiments thereof the ski and boot mounted members comprise a pair of side clamping members and a curved plate member. In one embodiment, the side clamping members are movable and mounted on a ski. The plate member is a rigid member with curved lateral edges and is mounted to the sole of the ski boot. In another embodiment, the movable clamping members are formed as plate-like clamping members with curved lateral edges and means for mounting the members on the sole of the ski boot. The ski mounted member comprises nonmovable upstanding members with inwardly facing proturberances for engaging the movable plate-like clamping members.

When inserting a conventional ski boot in any of the above described bindings, it is necessary to center the ski boot and its clamping members between the ski-mounted clamping members; but frequently this is difficult.

Conventional ski boots are generally constructed with a relatively wide lower shell with portions thereof in the vicinity of the clamping members overhanging the soles thereof. Without a clear view of the clamping members by the skier because of the width and overhanging construction of the typical ski boot shell, centering of the boot mounted clamping members between the ski mounted clamping members is often difficult. Frequently, to obtain a better view of the clamping members, a skier rolls the ski boot about the longitudinal axis thereof. This tends to remove the boot mounted clamping members from between the ski mounted clamping members. For these reasons, it is found to be particularly difficult to center the boot mounted clamping members between the ski mounted clamping members in deep snow, on icy surfaces and on steep slopes.

SUMMARY OF THE INVENTION

For the foregoing reasons, a principal object of the present invention is a ski binding having boot mounted and ski mounted clamping members for releasably securing a ski boot to a ski rearward of the toe and forward of the rear of the heel of the ski boot. In the binding there is provided a heel locating means for removably receiving the heel of the ski boot for centering the boot mounted clamping members between the ski mounted clamping members prior to closing of the binding.

In accordance with the above objects, a heel receiving means is mounted on the rear of the binding to provide rearward stoppage of the heel as a guide for the longitudinal position of the ski boot during its initial placement on the ski. Initial placement of the ski boot relative to the clamping members is critical to the clamping function.

In one embodiment, to facilitate removal of the heel of the ski boot from the heel receiving means, means are provided for moving the heel of the ski boot forwardly as the binding is closed.

To move the heel of the ski boot forwardly as the binding is closed, one of the clamping members is plate shaped. The plate shaped clamping member is provided with curved lateral edges, having a forward portion with a length and angle sufficient for moving the said ski boot forwardly a distance sufficient for the heel of said ski boot to clear the forward edges of the heel locating means during a lateral release as the plate and mating clamping members are engaged.

To ensure proper mounting of the ski boot before the clamping members are closed, the rear surface of the ski boot and the heel receiving means are each supplied with members that interlock with each other. These interlocking members are positioned to be in engagement when the heel is in contact with the heel receiving means yet not in contact with the ski, and not in engagement when the bottom surface of the boot heel is in contact with the ski. The heel receiving means has an opening at the base to permit separation of the heel and heel receiving means. The interlocking members thereby secure the heel against the heel receiving means during the lowering of the ski boot onto the ski, and permit separation of the heel and heel receiving means only after it has been fully lowered.

BRIEF DESCRIPTION OF THE DRAWING

The above and other objects, features and advantages of the present invention will become apparent from the following detailed description of the drawing in which.

DETAILED DESCRIPTION OF THE PREFERRED EMBODIMENTS

Figure 1:
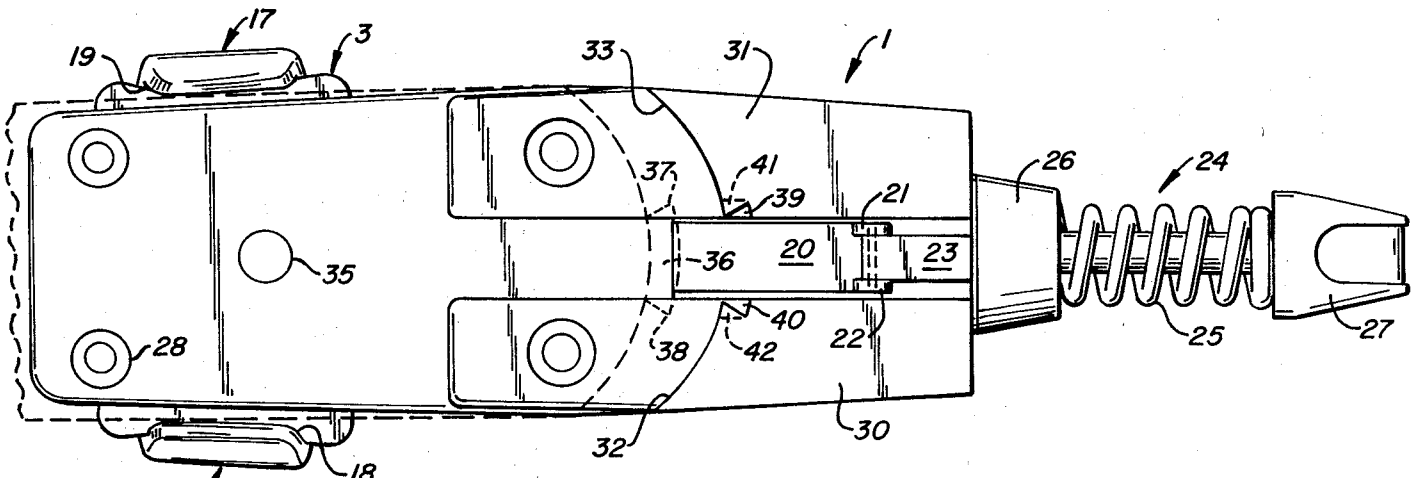
FIG. 1 is a plan view of a binding according to the present invention with the binding in a closed condition.

Referring to FIGS. 1-5 there is provided in accordance with the present invention a ski binding designated generally as 1 for releasably securing a ski boot 2, the outline of which is shown in dashed lines, to a ski 11 rearward of the toe and forward of the rear of the heel of the ski boot.

Mounted to the bottom of the ski boot 2 there is provided a plate member 3. As seen more clearly in FIG. 3, the plate member 3 is symmetrical about the longitudinal axis thereof and is provided with a pair of inwardly curved lateral edges 4 and 5, a pair of forward tip members 6 and 7 and a pair of rearward tip members 8 and 9. For mounting the plate member 3 to the sole of the ski boot 2, there is provided a plurality of screw receiving holes 10.

While symmetrical about the longitudinal axis thereof, the lateral edges 4 and 5 of the plate member 3 are asymmetrical with respect to its transverse midline designated as 13.

The length and angle of the forward portion of the curved lateral edges 4 and 5 are such that the position of the width of the plate 3 at its narrowest point is located rearward of the midline 13 by an amount corresponding to the distance the ski boot must be moved forwardly for the rear of the ski boot to clear the forward edges of a pair of heel receiving members 30 and 31 when the ski boot is secured in the binding 1 as described below.

In the binding 1 there is provided for engaging the plate member 3 a pair of side clamping members 16 and 17. The clamping members 16 and 17 are each provided with an inwardly directed proturberance 18 and 19 which, when the binding 1 is closed overlay the lateral edges 4 and 5 of the plate member 3.

For providing a clamping force to the clamping members 16 and 17 there is provided a connecting member 20, which is coupled to the clamping members 16 and 17 and which extends in a cavity provided therefor between the clamping members 16 and 17 to the rear of the binding 1. At its rear end, the connecting member 20 is provided with a pair of upstanding members 21 and 22. The members 21 and 22 are provided for movably coupling the connecting member 20 to a spring guide rod 23 in an overcenter spring mechanism designated generally as 24.

In the overcenter spring mechanism 24 there is provided a spring member 25 and a washer member 26. Coupled to the end of the rod 23 there is provided an adjusting nut 27. To mount the binding 1 to the upper surface of the ski there is provided a plurality of screw receiving holes 28.

At the rear of the binding 1, on opposite sides of the connecting member 20 and the spring guide rod 23, there is provided a heel receiving means 30 and 31. The heel receiving means may assume any shape or configuration which will serve as a rearward stop for the ski boot heel, extending high enough to effectively guide the heel portion during placement of the boot on the ski. It may, for example, be curved or flat. In preferred embodiments, the heel receiving means consists of a pair of curved members as shown in the drawing, provided respectively with curved forward surfaces 32 and 33. The curve of the surfaces 32 and 33 corresponds to the shape of the rear surface of the ski boot 2.

Located between the clamping members 16 and 17 there is provided a trigger member 35. The trigger member 35 is provided for closing the clamping members 16 and 17 with respect to the plate member 3 as described below and as further described in detail in U.S. Pat. No. 3,905,613.

Figure 4:
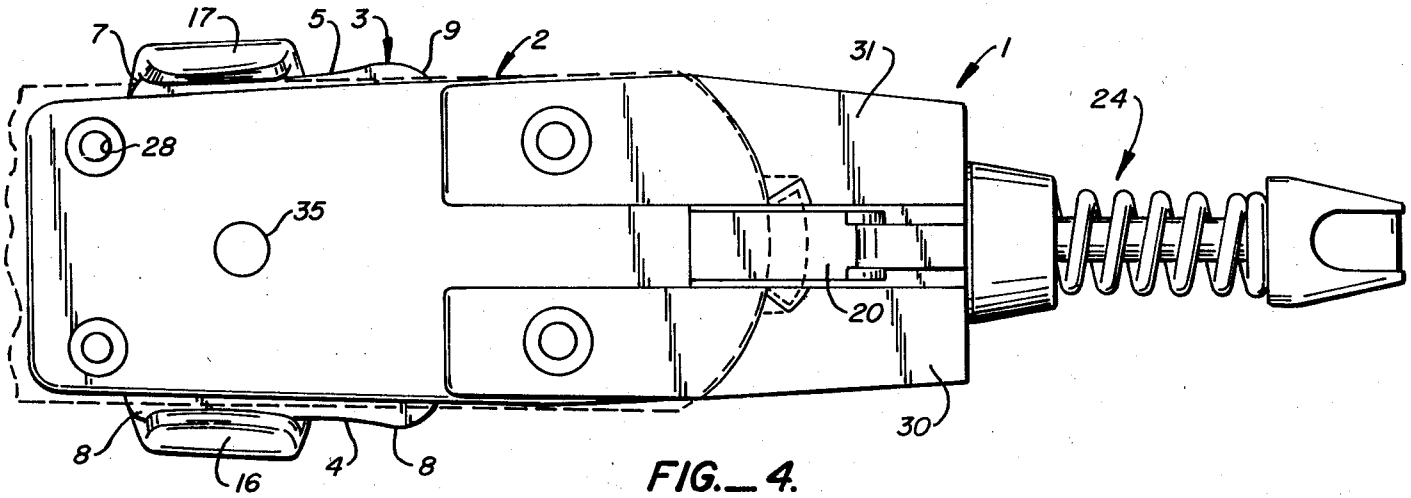
FIG. 4 is a plan view of the binding of FIG. 1 in an open condition.

In use, and as described in U.S. Pat. No. 3,905,613, the binding 1 is set by raising the spring mechanism 24 from its horizontal position as shown, to a vertical position. With the spring assembly 24 raised to its vertical position tension is removed from the spring rod 23 and the connecting member 20, allowing the clamping members 16 and 17 to be moved outwardly to their open position as shown in FIG. 4. With the connecting member 20 moved forwardly the trigger member 35 is elevated by a spring member (not shown). With the trigger member 35 in its elevated position, the spring assembly 24 is lowered to its horizontal position as shown in FIGS. 1 and 4. The lowering of the spring assembly to its horizontal position applies the clamping force of the spring 25 to the spring guide rod 23 and the connecting member 20; however, with the trigger member in its elevated position, the clamping members 16 and 17 are kept in their open position until the trigger member 35 is depressed.

Figure 5:
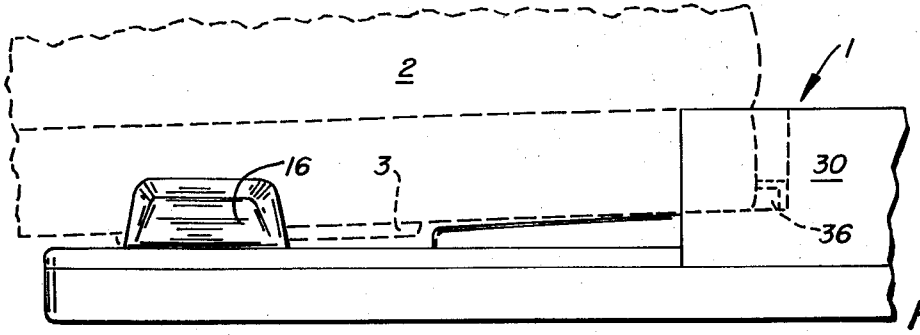
FIG. 5 is a partial side elevation view of FIG. 4.

With the clamping force applied to the connecting member 20 and the clamping members 16 and 17 held in their open position by the trigger member 35, a skier places the heel of a ski boot against the surfaces 32 and 33 as shown in FIGS. 4 and 5. As the heel of the ski boot is placed against the surfaces 32 and 33, the ski boot 2 is lowered between the clamping members 16 and 17. As the ski boot 2 is lowered between the clamping members 16 and 17 the plate member 3 contacts the trigger member 35 and depresses the trigger member 35. When the trigger member 35 is fully depressed the trigger member 35 disengages the connecting member 20. When the trigger member 35 is disengaged from the connecting member 20, the connecting member 20 is drawn rearwardly by the spring 25. As the connecting member 20 is drawn rearwardly by the spring 25, the clamping members 16 and 17 coupled to the forward end thereof are drawn inwardly engaging the plate member 3.

Figure 3:
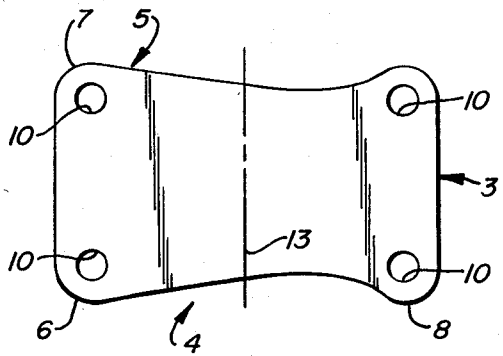
FIG. 3 is a plan view of a plate adapted for mounting to the sole of a ski boot for use of the binding of FIGS. 1 and 2.
Figure 2:
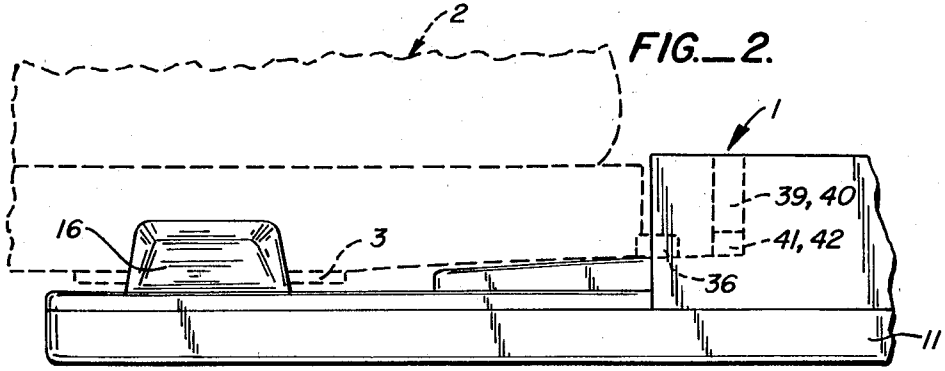
FIG. 2 is a partial side elevation view of FIG. 1.

As the clamping members 16 and 17 engage the lateral edges 4 and 5 of the plate member 3 the plate member 3 is drawn forwardly until the narrowest part of the plate member 3 is centered between the clamping members 16 and 17. As can be seen in FIG. 3 and as described above, the narrowest part of the plate member 3 is located at a distance rearward of the midline 13 by an amount sufficient for the heel of the ski boot 2 to clear the forward edge of the heel locating means 30 and 31 during a lateral release.

The rear surface of the ski boot and the heel receiving means are each shaped to form members which can interlock with each other to secure the heel against the receiving means during the downward travel of the heel as the boot is placed in position on the ski preparatory to the clamping action. The shape and configuration of the means are not critical, provided interlocking is achieved. They can conveniently consist of a projecting member on the boot heel and a complimentary elongate recess in the heel receiving means, or vice versa. In any case they are shaped such that the interlocking effect exists only when there is a vertical gap between the base of the boot heel and the ski surface, and not when the boot heel is fully lowered.

A preferred embodiment of the interlocking members is that shown in the drawings, wherein one such member is a wedge-shaped tab extending backward from the rear surface of the ski boot at the base thereof, and the other such member is an elongate recess in the heel receiving means of cross-section complimentary to the wedged shape of the tab.

The tab 36, preferably flat and horizontal, terminates at two corners 37 and 38. The corners 37 and 38 each extend laterally beyond the width of the gap between the heel locating members 30 and 31 on the binding. The term "wedge-shaped" is used herein to indicate that the tab width along the line intersecting these two corners is greater than the width along the line where the tab joins the rear of the ski boot.

Notches 39 and 40 complimentary in shape to the corners 37 and 38, respectively, are located in each of the heel locating members, for receiving the corners. The notches together form a vertical passage for guiding the ski boot during placement of the latter in the binding and thereby prevent both forward and lateral motion of the ski boot relative to the binding during placement.

At the base of each of the notches 39 and 40 in the heel locating members is an opening 41 and 42, respectively, which permits forward movement of the ski boot. The openings 41 and 42 are shown as a widening of the notch walls so that the notches no longer retain the wedge, and the tab and boot are thus free to move forward. As a result, longitudinal movement of the ski boot is prevented only while the boot is being lowered into position on the ski. The location and shape of these openings ensures full contact between the rear boot surface and the inner curved surface of the heel locating means while the ski boot is being lowered into place, thereby preventing the inadvertent actuating of the trigger member and closing of the clamping members without the ski boot plate member 3 being properly in position. As shown in FIG. 1, the openings 41 and 42 are formed by a widening of the notches at their inward pointing edges to form a pair of parallel facing walls forming a channel slightly wider than the widest part of the tab 36 in an alternative embodiment.

Figure 6:
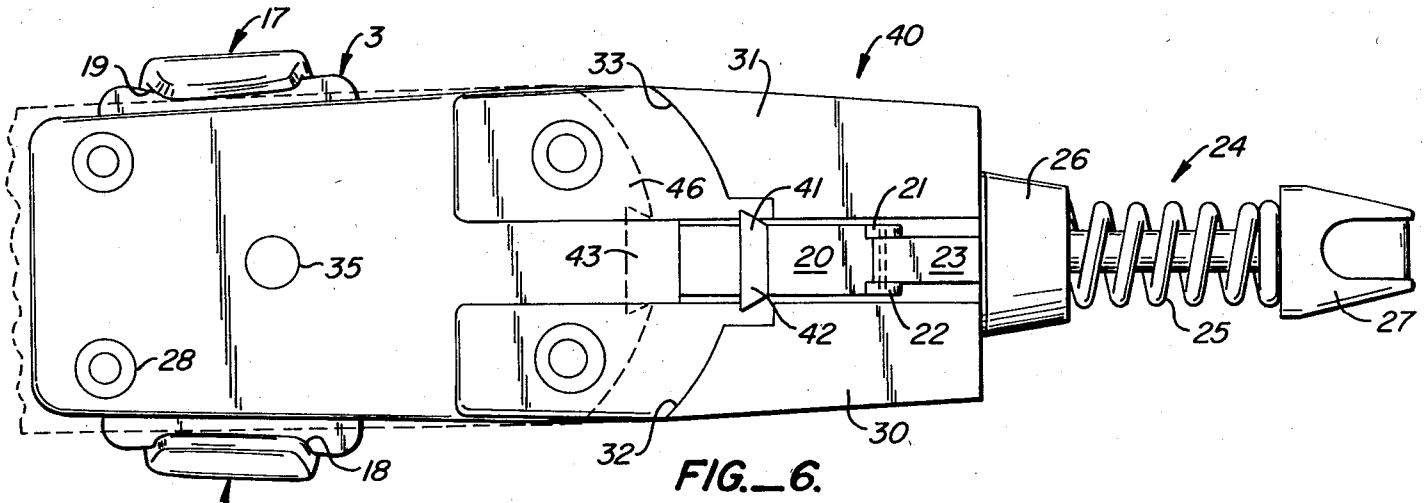
FIG. 6 is a partial plan view of an alternative embodiment of the present invention with the binding in a closed condition.
Figure 7:
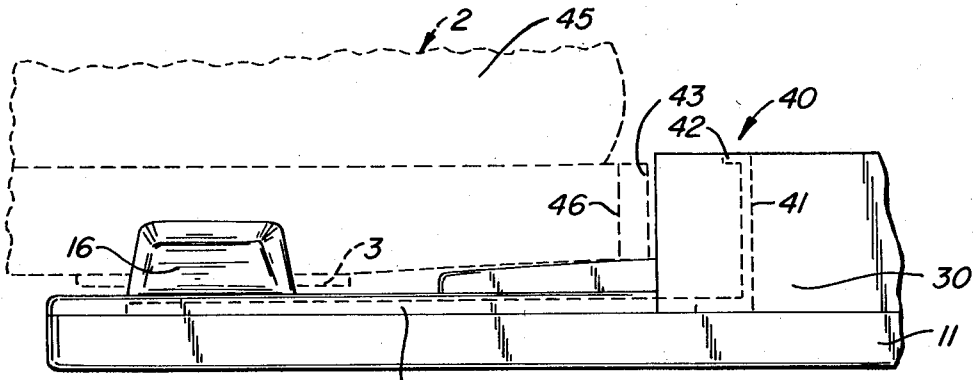
FIG. 7 is a partial side elevation view of FIG. 6.

Referring to FIGS. 6 and 7, there is provided in accordance with the present invention a ski binding designated generally as 40. The various components of the binding 40 are the same as those shown in FIGS. 1-5 except as hereinafter disclosed. Secured to the connecting member 20 is an upstanding boot engagement member 41 that includes a forwardly extending wedge shaped heel receiving tab 42 for interlocking engagement with a wedge shaped notch 43 in the ski boot 45 heel ledge 46.

In use, with the clamping members in their open position and the connecting member 20 in a forward position, the skier places the heel ledge 46 notch 43 over the heel receiving tab 42 and lowers the ski boot 45 between the clamping members 16 and 17. As the ski boot 45 is lowered between the clamping members 16 and 17 the boot plate member 3 contacts the trigger member 35 disengaging the connecting member 20 which moves to a rearward position away from the ski boot. Also, when the plate member 3 contacts the trigger member the ski boot heel ledge is below the level of the heel receiving tab permitting separation of the ski boot heel and heel receiving means.

While an embodiment of the present invention is disclosed and described it is contemplated that various modifications may be made thereto without departing from the spirit and scope of the present invention. For example, the present invention is described with movable side clamping members mounted to the surface of a ski and a rigid plate having curved lateral edges mounted to the sole of the ski boot. The functions of the ski and boot mounted members may be revised by mounting the movable part in the sole of a ski boot and mounting rigid upstanding members on the surface of a ski as disclosed in applicant's U.S. Pat. No. 3,606,370. For this reason, it is intended that the scope of the present invention be determined not by reference to the embodiment disclosed but by the claims hereinafter provided and their equivalents.

What is claimed is:

1. In a ski binding adapted to be attached to a ski for securing a ski boot having a sole and a heel to the ski, the boot including longitudinally extending edges protruding laterally from the sole, and the binding including lateral clamping members adapted to be closed against the laterally protruding edges for engaging the laterally protruding edges and thereby securing the boot to the binding and the ski, the improvement comprising: positioning means for securing the heel against longitudinal movement and for longitudinally centering the boot relative to the binding while the boot is being moved towards the binding in a direction generally perpendicular to the sole, the positioning means being adapted to release the heel of the boot when the sole is in a position proximate the binding and in which the jaws are in substantial operative alignment with the laterally protruding edges, and means operatively coupled with the binding for moving the heel of the boot away from the positioning means in response to the closure of the binding and the engagement of the laterally protruding edges by the jaws.

2. The improvement according to claim 1 wherein said means for moving the heel includes portions on said jaws which have a length and an angle adapted to engage the laterally protruding edges for moving said ski boot forwardly as said ski binding is closed.

3. The improvement according to claim 1 wherein said positioning means comprises a tab protruding rearwardly from the heel and means connected with the binding for receiving and retaining said tab.

4. The improvement according to claim 3 wherein said tab is wedge shaped.

5. The improvement according to claim 3 wherein said tab is located at a base of said ski boot heel.

6. The improvement according to claim 1 wherein said positioning means comprises a notch in the heel and means connected to the binding for engaging and releasing said notch.

7. The improvement according to claim 6 wherein said notch is wedge shaped.

8. The improvement according to claim 1 wherein the binding includes heel receiving means which is complementary in shape to said ski boot heel.

* * * * *